US006364015B1

(12) United States Patent
Upchurch

(10) Patent No.: US 6,364,015 B1
(45) Date of Patent: Apr. 2, 2002

(54) METHOD OF DETERMINING FRACTURE CLOSURE PRESSURES IN HYDRAULICFRACTURING OF SUBTERRANEAN FORMATIONS

(75) Inventor: Eric R. Upchurch, Long Beach, CA (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/368,759

(22) Filed: Aug. 5, 1999

(51) Int. Cl.[7] ..... E21B 47/06
(52) U.S. Cl. ..... 166/250.1; 166/308; 73/152.38
(58) Field of Search ..... 166/250.1, 250.07, 166/308, 280; 73/152.51, 152.38, 152.54

(56) References Cited

U.S. PATENT DOCUMENTS

| | | | | | |
|---|---|---|---|---|---|
| 4,867,241 | A | * | 9/1989 | Strubhar | 166/308 |
| 5,050,674 | A | * | 9/1991 | Soliman et al. | 166/250 |
| 5,305,211 | A | * | 4/1994 | Soliman | 364/422 |
| 5,497,831 | A | * | 3/1996 | Hainey et al. | 166/308 |

* cited by examiner

*Primary Examiner*—William Neuder
*Assistant Examiner*—Zakiya Walker
(74) *Attorney, Agent, or Firm*—Richmond, Hitchcock, Fish & Dollar

(57) ABSTRACT

The closure pressure ($P_c$) of a fracture generated in a subterranean formation is determined by creating a fracture in the formation, permitting the fracture to close, and performing post-closure pulse testing. The method is particularly applicable to soft formations (i.e. those having a rock plain-strain modulus (E') of less than 800,000 psi).

16 Claims, 3 Drawing Sheets

METHOD OF DETERMINING FRACTURE CLOSURE PRESSURES IN HYDRAULICFRACTURING OF SUBTERRANEAN FORMATIONS

BACKGROUND OF THE INVENTION

This invention relates generally to the hydraulic fracture stimulations of subterranean formations. In one aspect, it relates to determining closure pressure of hydraulically induced fractures in formations by pulse testing.

Hydraulic fracturing is a production stimulation technique involving the pumping of a hydraulic liquid down a wellbore and into a subterranean formation at such a pressure and rate to cause the formation to crack (fracture). In the vast majority of such treatments, the fracture is vertical, extending outwardly into the formation from the wellbore. During the latter stages of a fracturing treatment, a particulate propping agent (proppant) is generally deposited in the fracture. When the injection pressure is released, the formation walls close on the propping agent creating a "propped fracture" which provides a high conductivity channel in the subterranean formation. The conductivity of the propped fracture is the product of fracture width and fracture permeability. Permeability can be estimated by the size of the proppant. However, in order to generate sufficient fracture width, it is necessary to obtain a tip screenout (TSO) in the formation. Obtaining a TSO at the correct time is heavily dependent upon an accurate estimate of the fluid leakoff coefficient ($C_L$)—the rate at which fluid leaks off from the fracture to the surrounding rock. It is known that an accurate measurement of $C_L$ is based on an accurate determination of fracture closure time ($t_c$), which, in turn, is based on fracture closure pressure ($P_c$).

For a given volume of fluid pumped into a fracture ($V_1$), the fracture will require a specific amount of time to close ($t_c$), depending on how quickly the fluid filling the fracture leaks off to the surrounding formation. The fracture closes only after all the fluid filling the fracture leaks off. As the fluid leaks off, the gradual closure of the fracture is accompanied by a gradual decline of the pressure inside the fracture. The time required for the fracture to completely close ($t_c$) coincides with the fracture closure pressure ($P_c$). The fluid volume ($V_1$) and $t_c$ are used in subsequent computer simulations for designing the main propped fracture stimulation treatment. Only by accurately determining $P_c$, can $t_c$ be determined, which, in turn, is used to calculate $C_L$.

Thus, an accurate determination of $P_c$ is a key to the design of a fracture treatment. The most common techniques for the onsite determination of $P_c$ are pressure decline analysis, constant-rate flowback testing, and pulse testing.

Pressure decline analysis (briefly alluded to above) involves creating a fracture using a known volume of fluid ($V_1$) pumped at a constant rate. After pumping is complete and the pumps are shut down, the pressure in the fracture will decline as the fluid in the fracture leaks off to the surrounding formation. In many instances, plotting the declining pressure versus the square-root (SQRT) of the elapsed time since pump shut-down (dt) results in a curve with 2 linear sections of different slopes. The intersection of the 2 linear sections is the point of fracture closure and, thus, defines the values of $P_c$ and $t_c$ (see FIG. 3 for an example). In some cases the pressure vs. SQRT (dt) plot (i.e., the pressure decline plot) does not yield a clear slope change for determining $P_c$ and $t_c$. In these instances, other methods must be used to determine PC, which can then be used with the original pressure decline plot to determine $t_c$. The most common of these alternate methods are constant-rate flowback testing and pulse testing.

Constant-rate flowback testing involves creating a fracture followed by flowing fluid back from the fracture at a constant rate. This method results in a relatively slow drop in pressure while the fracture is open followed by a more rapid drop in pressure once the fracture closes. This test works well if the flowback rate is held constant during the test. Maintaining a constant flowback rate, however, is sometimes very difficult when applying this method.

A recent SPE publication, *SPE Production and Facilities* (August 1996), by C. A. Wright, et al., describes the use of fluid pulse testing for determining $P_c$. Wright's concept of pulse testing involves creating a fracture followed by pumping small fluid pulses intermittently as the fracture gradually closes. The pressure response from each fluid pulse is analyzed to determine if the fracture is open or closed at the time the pulse was pumped. The pressure response of an open fracture is different than that of a closed fracture. This method is robust and can be easily utilized in most situations. This method, however, determines only a range of possible $P_c$'s and not a specific $P_c$.

There is a need for a robust, on-site technique that is similar to the pulse testing technique described above, but can actually determine a specific, singular value of $P_c$ rather than only range of possible $P_c$'s. Being able to determine a specific value of $P_c$ with such a test would increase the accuracy of determining $C_L$ (a critical variable in the design of fracture stimulation treatments).

SUMMARY OF THE INVENTION

In its broadest aspect, the method of the present invention involves four main steps:

(a) pumping a large volume of fluid ($V_1$), relative to step (c), down a wellbore and into a subterranean formation to form a fracture therein for data;

(b) permitting the fracture to close;

(c) pumping a small volume of fluid ($V_2$), relative to step (a), into the formation to reopen the fracture more narrowly than in step (a); and (d) shutting down the pumping operation and determining the pressure in the wellbore at shutdown.

As described below, the pressure determined in step (d) is the initial shutin pressure (ISIP) and is a very close approximation of $P_c$. The $P_c$ is used to determine the $t_c$ in the pressure decline analysis technique (if $t_c$ cannot be clearly determined from the pressure decline plot itself). The $t_c$ is used, in turn, to determine $C_L$. The value of $C_L$ is then used to design the fracture treatment, along with other essential data, using known computer simulation techniques.

In a preferred embodiment, the process may include additional steps of (a) using an initial water breakdown to insure open perforations and that adequate injection rates can be obtained, and (b) proppant scouring prior to fracture generation with a low density proppant slug to scour tortuous fracture paths and help plug multiple fractures.

The variables involved in carrying out the four steps may range within wide limits depending on the factors including formation thickness, formation tensile strength, formation toughness, formation pressure, and pumping equipment, etc.

However, the following parameters are important for the success of the present invention: (1) the data fracturing step must generate a fracture of larger dimensions than the small volume pulse testing and (2) the pulse testing step should be at low volume (e.g. 0.5 to 3 bbls per pulse) and low injection rates (e.g. 2 to 5 bpm).

Other important factors, discussed in detail below, are minimizing near wellbore tortuosity, use of low viscosity fluids as pulse fluids, and frequent data recording.

Figure 1:
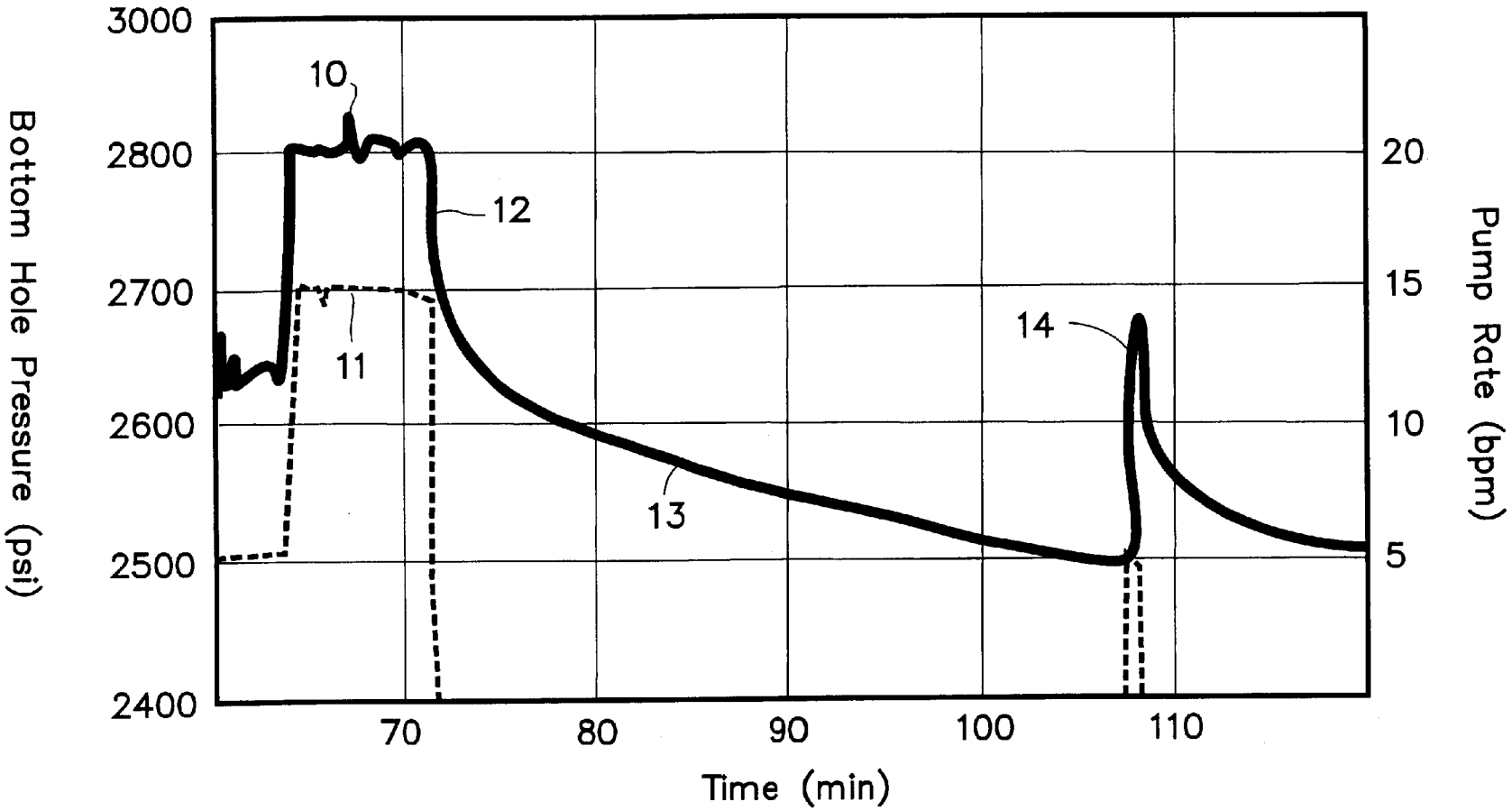
FIG. 1 is a plot of bottom hole pressures and pump rates vs. time recorded in a field test according to the present invention.

Abbreviations shown on the drawings and used herein are defined in the Nomenclature section at the end of Description of the Preferred Embodiments.

DESCRIPTION OF THE PREFERRED EMBODIMENTS

The method of the present invention is a testing method for determining fracture closure pressures $P_c$, the value of which can be used in the design of a fracturing treatment of subterranean formations. The method can be used in any formation, but is particularly applicable in soft formations (i.e., those having a rock plain-strain modulus, E', of less than 800,000 psi).

As indicated above, the method involves four essential steps: generating a fracture, permitting the fracture to close, pulse testing, and determining the ISIP for each pulse test. For optimum results, however, the method preferably includes the following five sequential steps:

(1) water breakdown, (2) proppant scour step, (3) generating a fracture-for-data, (4) permitting the fracture to close, (5) post-closure pulse testing, including determination of ISIP.

Each of these steps are described below in detail.

Water Breakdown

As is customary in the hydraulic fracturing of subterranean formations, the initial step is to pump a small volume of water into the formation to break down the perforations and ensure adequate injection rates can be achieved. The water breakdown step generally, but not always, initiates the fracture.

Proppant Scour Step

After a small volume of water or gel is pumped into the formation, a low-density slurry of particulate material is injected into the formation. The purpose of the scour step is to minimize both the near wellbore fracture tortuosity and multiple fractures. The slugs of slurry scour out tortuous paths and plug multiple fractures. At this point, preliminary pulse testing may be carried out with the fracture open to obtain a rough estimate of $P_c$ before generating a fracture-for-data (the next step).

The injection may be in slugs of several barrels each. The slurry may be water or an aqueous solution of a polymer. Any of the polymers currently used as viscosity fracturing fluids may be used.

The particulate material may be finely divided fluid loss additive such as silica sand, but preferably is a propping agent. The proppant density in the liquid is low, between about 0.2 to 4 lbs/gal of liquid, preferably between 0.5 to 3, most preferably between 1 to 2 pounds per gallon of liquid. While injection volume rates and pressures will depend on the condition of a particular application, the example described later on exemplifies a typical treatment.

Generating or Propagating the Fracture for Data

A volume ($V_1$) of fracturing fluid is pumped into the formation to generate a fracture therein (if the previous steps were not performed, or did not initiate the fracture) or propagate the fracture if such previous steps were performed. This fracture is created to obtain data (i.e. $P_c$ and $t_c$) and not to stimulate formation production or injection. As indicated earlier, the data will be used to determine $C_L$ for use in designing the fracture treatment.

The fracturing fluid may be any of the viscosified aqueous and oil-based fluids, but preferably is an aqueous linear polymer gel (e.g. guar). The viscosity, other additives, pumping rates and volume may be in accordance with fracturing techniques well-known in the art; all that is necessary is that the fracture have dimensions larger than that possible with the volume used in pulse testing ($V_2$). Preferably, at least 50 barrels are used to generate the fracture for data. The upper limit of the volume can be that used to generate the fully propagated fracture (e.g. 1000 bbls). The preferred volume for generating the fracture for data is from 50 to 300 barrels; and the most preferred volume is 100 to 200 bbls.

Fracture Closure

This is a key step in the method of the present invention because the pulse testing is carried out after the fracture closes. Once the fracture has been generated, the pumps are shut down. The fracture closes by fluid leakoff into the formation. Closure is indicated when the pressure in the wellbore is below $P_c$ determined at the conclusion of the fracture step (but possibly unknown at this point, if previous steps for determining $P_c$ were inconclusive).

Normally, fracture closure will occur from 5 to 60 minutes after pump shutdown.

Postclosure Pulse Testing

Once the fracture is closed, the pulse testing may be carried out. The pulse testing fluid is water or a low viscosity aqueous polymeric solution. Linear polymer gels such as guar have been used with success. Other gelling polymers well-known to those skilled in the art may be used. The concentration of the polymer in the water may range within wide limits, but concentrations from 10 to 100 pounds per 1,000 gallons of water are preferred. For example, linear guar gel at 70 pounds per 1,000 gallons of water have given good results. The viscosity of the pulse fluid is preferably less than 70 centipoise.

The volume ($V_2$) of each pulse should be small in relation to the volume used to form the fracture ($V_1$). Each pulse travels through the preexisting fracture and does not extend or propagate the fracture. The relatively low volume pulse travels through the preexisting fracture unimpeded by tip effects such as fracture toughness and rock tensile strength. This permits the pulse to disperse more rapidly down the fracture length. This results in a minimum fracture width ($w_f$) which, in combination with a low plain-strain modulus ($E'$) of the rock, results in a negligible fracture net pressure at the wellbore ($P_{net}$). As well understood by those skilled in the art, when $P_{net}$ is small, ISIP becomes a very close approximation of $P_c$.

The volume of each pulse should be in the range of 0.5 to 5 bbls, preferably 0.5 to 3 bbls, and most preferably between 1 and 2 bbls. The 1 to 2 bbl range appears to be optimum because it is large enough to ensure fracture reopening and small enough to minimize fracture width.

The pumping rate for each pulse preferably should be from 1 to 10 bpm, and most preferably from 2 to 5 bpm. Typical pumps used in fracturing operations can achieve a minimum pump rate of about 5 bpm.

The low rate, low volume pulse dictates the length of pulse pumping time, which typically is from 15 to 60 seconds.

After the pulse volume is pumped to reopen the fracture, the pump is shut down and the pressure (ISIP) at the wellbore opposite the fracture is determined. The ISIP is equal to, or very close to, $P_c$.

The equipment for measuring the pressure at pump shutdown should be accurate (within 3 psi) and should record the pressure data at intervals not longer than 2 second intervals, preferably not longer than 1 second intervals.

Care must be exercised in identifying the ISIP from the pressure/time chart because of pressure fluctuations at shutdown due to water hammer. The actual ISIP on the pressure chart is the average of the first full cycle of pressure fluctuation at pump shutdown. (This will be demonstrated in the discussion relating to the field experiment.) The ISIP represents a close approximation of the fracture closure pressure ($P_c$).

Operations

The best mode of the method according to the present invention involves the five steps described above. It, again, is emphasized, however, that the process in some applications may involve only three steps: (1) generating a fracture-for-data, (2) fracture closure, and (3) postclosure pulse testing (which includes determining ISIP). For example, if fracture tortuosity is not a problem, the proppant scour step may be omitted. Also, the water breakdown step may not be needed if injection capabilities for a particular formation are known. However, good field practice suggests that all five steps be used to determine $P_c$.

The following presents an example of the best mode for carrying out the process.

| | | Injection | |
|---|---|---|---|
| Step | Fluid | Volume (bbls) | Rate (bpm) |
| 1. Water Breakdown | Water | 25 to 100 | 15 to 30 |
| 2. Proppant Scour With 5 slugs of linear fluid | | | |
| slug 1 | Linear or Cross-Linked Gel | 50 | 15 to 30 |
| slug 2 | Linear Gel or Cross-Linked with 1 ppa* | 30 | 15 to 30 |
| slug 3 | Linear Gel or Cross-Linked with 2 ppa* | 30 | 15 to 30 |
| slug 4 | Linear or Cross-Linked Gel | 20 | 15 to 30 |
| slug 5 | Water | flush to perf. + 50 | 15 to 30 |
| 3. Generate Fracture-for-Data | Linear or Cross-Linked Gel | 100 to 200 | 15 to 30 |
| 4. Permit fracture to close | | | |
| 5. Postclosure Pulse Testing | | | |
| Pulse | Water or Linear Gel | 1 to 2 | 5 |

*ppa = lbs. of sand (proppant) per gallon of fluid

The bottom hole pressure data can be obtained with (a) a downhole transducer or (b) recorded at the surface and converted to downhole pressure.

During the pulse testing, the pressure is recorded every second and the value of $P_c$ determined at pump shut-in for each pulse. The pressure decline curve may be plotted as pressure vs. square root of time (dt) and is used to determine $t_c$. The field example will demonstrate the complete process and determination of $t_c$ corresponding to $P_c$.

EXPERIMENTS

The method of the present invention was performed in an Alaskan North Slope well having a formation with a rock plain-strain modulus (E') of 300,000 psi. Following water breakdown step, and proppant scour steps, 100 barrels of a linear water gel (guar) was pumped into the formation at a rate of 15 barrels per minute to generate a fracture. The pumps were shut down permitting the pressure in the fracture to bleed off, closing the fracture. Pulse testing was performed using a pulse volume of 1 to 2 barrels pumped at a rate of 5 bpm.

Figure 2:
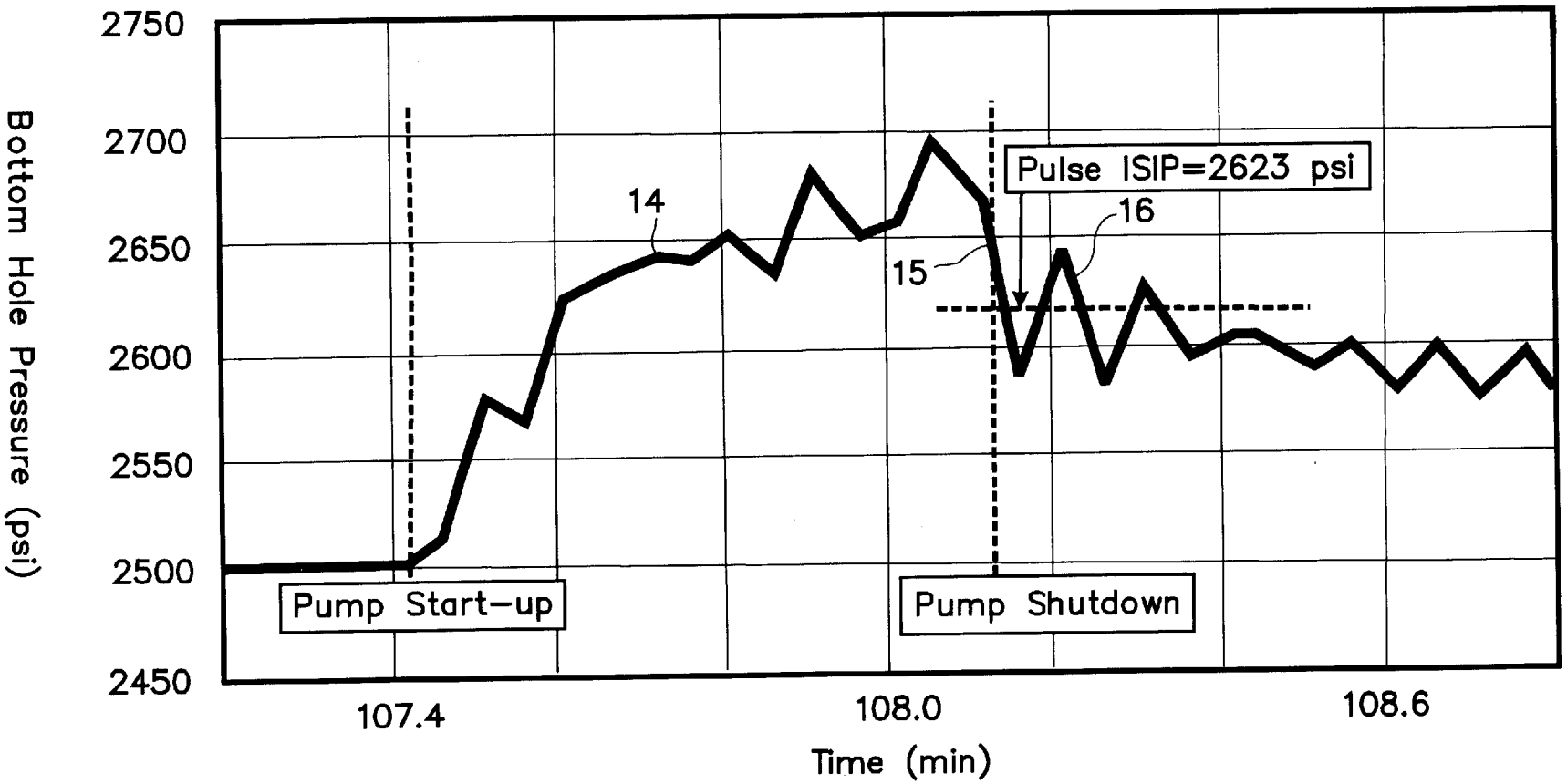
FIG. 2 is a zoomed-in portion of FIG. 1, illustrating pressure at frequent time intervals.

FIG. 1 is a plot of bottom hole pressure and pump rate vs. time for the field test. FIG. 2 is a zoomed in view of FIG. 1 focusing on the pulse test. The data in both figures was taken at one-second intervals.

Returning to FIG. 1, the fracture was generated at a pressure of about 2800 psi (as indicated by reference numeral 10), and an injection rate of 15 bpm (as indicated by reference numeral 11).

The pumps were shut down at time of about 71 minutes (reference numeral 12) and the pressure declined during the time interval indicated by reference numeral 13. When the pressure had declined sufficiently to ensure fracture closure, the postclosure pulse test was performed. One to two barrels of the linear gel were pumped into the formation at 5 bpm, as indicated by reference numeral 14. Returning to FIG. 2, the pumps were shut down at a time of 108.1 minutes (reference numeral 15) and the bhp pressure immediately dropped. During the first few seconds after pump shutdown, the pressure fluctuated between about 2590 and 2640 because of water hammer's effect. The average of first full pulse cycle of the pressure fluctuation was 2623 psi indicated by reference numeral 16. This average reading is the ISIP and represents a close approximation of $P_c$. The correlation of ISIP and $P_c$ was confirmed by the plot of FIG. 3. This figure is a plot of the square root of square root of time (SQRT) vs. bottom hole pressure based on portion 13 of FIG. 1.

Figure 3:
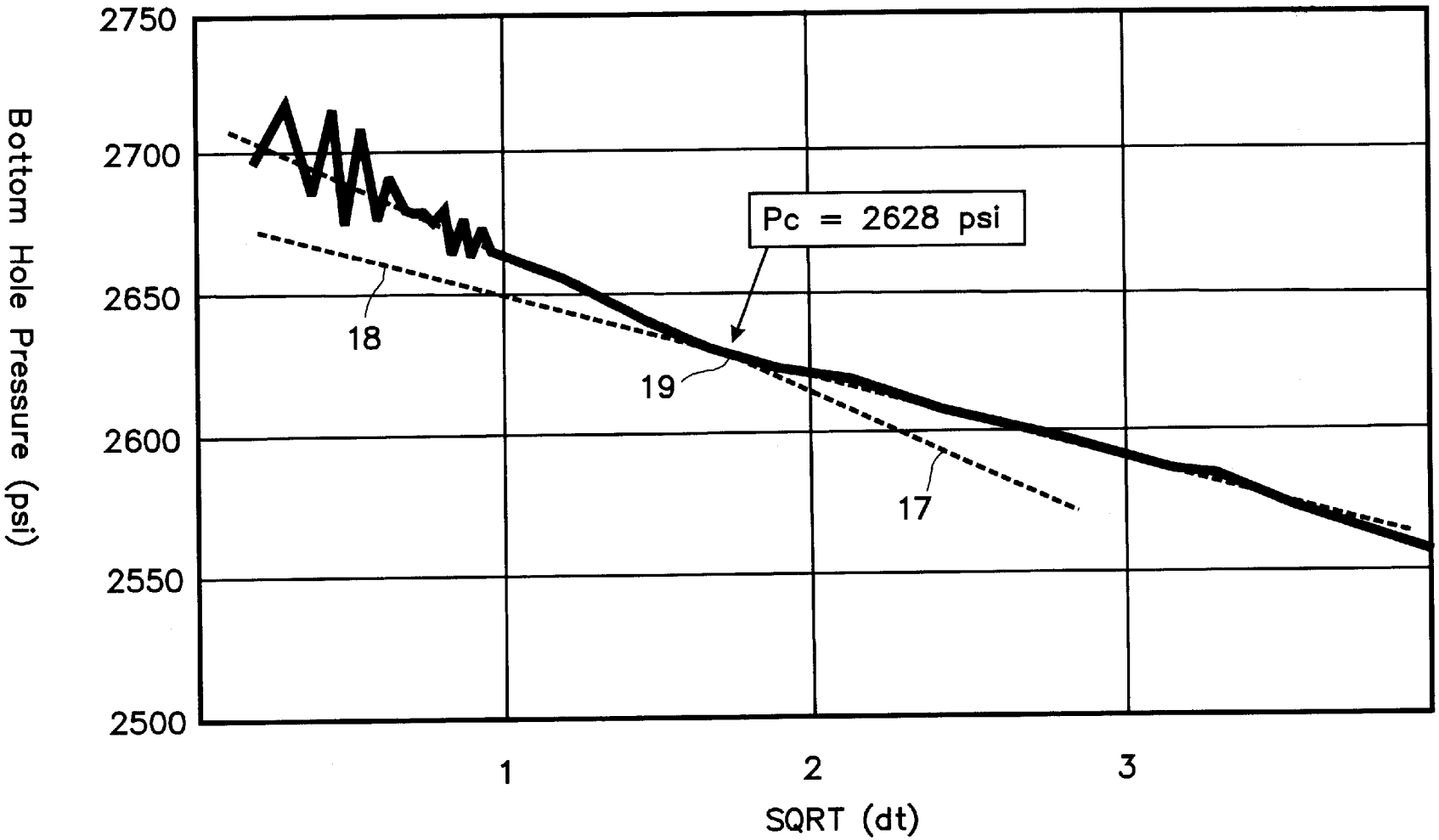
FIG. 3 is a pressure decline curve useful in correlating closure pressure and ($P_c$) fracture closure time ($t_c$).

As is well-known in the art, the intercept of line 17 and line 18 as at 19 on the pressure decline curve (FIG. 3) is $P_c$. (Line 17 is the pressure decline while the fracture is still open, and line 18 is the pressure decline after the fracture closes.) The intercept 19 occurs at about 2628 psi, which correlates well with ISIP of 2623 on FIG. 2. The dt value at a $P_c$ of 2623 on FIG. 3 is about 1.8, giving a $t_c$ of about 3.25 min. This value of $t_c$ can be used in computer simulations to determine $C_L$, which, in turn, is used to design the fracture treatment for the formation tested.

In many field operations, the pressure decline curve does not provide a clear indication of fracture closure. For example, the straight-line portions 17 and/or 18 of FIG. 3 may not be discernible, in which case the value of $P_c$ can not be determined. However, by using the $P_c$ determined by the plot of FIG. 2, the value of $t_c$ can be determined by correlating the value to a dt on the pressure decline curve (FIG. 3).

In actual field practice, it may be desirable to perform multiple pulses to obtain corroborating data concerning the ISIP. Actual field tests carried out in a North Slope well have demonstrated the repeatability and reliability of multiple pulses in the well following water breakdown and scouring steps.

In summary, actual field tests have demonstrated that the method of the present invention is a simple and reliable on-site technique for accurately determining $P_c$ and $t_c$.

Nomenclature

The abbreviations and symbols used herein are based on standards used in the petroleum industry.

$C_L$=Fluid leakoff coefficient, ft/min$^{0.5}$
dt=Elapsed time since pump shut-down
E'=Rock plain-strain modulus, psi
$P_c$=Fracture closure pressure, psi
$P_{net}$=Fracture net-pressure at wellbore, psi
$t_c$=Fracture closure time after pump shutdown, minutes
ISIP=Instant shutin pressure (psi)
SQRT=Square root of time
$V_1$=Volume of fluid used to generate a fracture for data
$V_2$=Volume of fluid used in each pulse
ppa=Pounds of proppant per gallon of fluid
bpm=Barrels per minute
bbls=Barrels
psi=Pounds per square inch gage
$w_f$=Fracture width

What is claimed is:

1. A method of determining the instant shut-in pressure (ISIP) of a fracture in a subterranean formation penetrated by a wellbore which comprises:

(a) generating a fracture in the formation by pumping a volume ($V_1$) of fluid down the wellbore and into the formation;

(b) permitting the fracture to close; and (c) pulse testing the formation by pumping a pulse of fluid ($V_2$) into the formation to reopen the fracture, said volume $V_2$ being substantially less than volume $V_1$, so that the fracture is opened more narrowly than in step (a); and (d) determining the instant shut-in pressure (ISIP) from the average of the first full pulse cycle of pressure fluctuation after pump shutdown.

2. The method of claim 1 wherein the volume $V_1$ is in excess of 50 barrels.

3. The method of claim 2 wherein the volume $V_1$ is at least 100 barrels.

4. The method of claim 1 wherein the volume $V_2$ is sufficiently low in relation to $V_1$ such that the dimensions of the fracture created by $V_1$ exceeds the dimensions of a fracture created by $V_2$.

5. The method of claim 4 wherein the volume $V_2$ is from about 0.75 barrel to about 2.5 barrels.

6. The method of claim 1 wherein the pumping rate of volume $V_2$ is 5 barrels per minute or less.

7. The method of claim 1 wherein the volume $V_1$ is from 100 to 200 barrels.

8. The method of claim 1 wherein the fluid of step (c) is selected from water and an aqueous polymer solution.

9. The method of claim 8 wherein the aqueous polymer solution is a linear gel comprising water and from 10 to 100 pounds of a polymer per 1000 gallons of water.

10. The method of claim 1 and further comprising, prior to generating the fracture, a slurry of fluid and particulates are pumped down the wellbore and into the formation to scour tortuous paths in the formation and plug multiple fractures.

11. The method of claim 10 wherein the slurry is selected from water and an aqueous polymer solution containing 0.2 to 4 pounds proppant per gallon of aqueous polymer solution.

12. The method of claim 1 and further comprising the step of determining fracture closure time ($t_c$) using the determined ISIP.

13. The method of claim 1 wherein the formation has a rock plain-strain modulus (E') of less than about 800,000 psi.

14. A method of determining fracture instant shut-in pressure (ISIP) in a subterranean formation having a rock plain-strain modulus (E') of less than aobut 800,000 psi, said method comprising the steps of:

(a) breaking down the formation by pumping water down the wellbore and into the formation;

(b) pumping a scouring fluid down the wellbore and into the formation;

(c) propagating a fracture in the formation by pumping a volume ($V_1$) of fluid down the wellbore and into the formation;

(d) permitting the fracture to close;

(e) pulse testing the formation by pumping a pulse of fluid ($V_2$) into the formation to reopen the fracture, $V_2$ being substantially less than $V_1$, so that the fracture is opened more narrowly than in step (c);

(f) discontinuing the pumping of $V_2$ into the formation; and (g) determining the ISIP from the average of first full pulse cycle of pressure fluctuation after pump shutdown.

15. The method of claim 14 wherein $V_1$ is from 100 to 200 barrels and $V_2$ is from 1 to 2 barrels.

16. The method of claim 15 wherein the pump rate for step (e) is not in excess of 5 bpm.

* * * * *